US005083111A

United States Patent [19]

Drucker et al.

[11] Patent Number: 5,083,111

[45] Date of Patent: Jan. 21, 1992

[54] JAMMING APPARATUS FOR ELECTRONIC ARTICLE SURVEILLANCE SYSTEMS

[75] Inventors: Frank Drucker, Tamarac; Craig Szklany, Boynton Beach, both of Fla.

[73] Assignee: Sensormatic Electronics Corporation, Deerfield Beach, Fla.

[21] Appl. No.: 618,047

[22] Filed: Nov. 26, 1990

[51] Int. Cl.[5] ..... G08B 13/14; H04K 3/00

[52] U.S. Cl. ..... 340/572; 455/1

[58] Field of Search ..... 340/572; 455/1

[56] References Cited

U.S. PATENT DOCUMENTS 4,686,513 8/1987 Farrar et al. ..... 340/572

4,769,631 9/1988 Copeland ..... 340/572 X 4,821,023 4/1989 Parks ..... 340/572 X 4,866,424 9/1989 Parks ..... 340/572 X 4,888,579 12/1989 ReMine et al. ..... 340/572

4,893,027 1/1990 Kammerer et al. ..... 340/572 X

*Primary Examiner*—Glen R. Swann, III

*Assistant Examiner*—Thomas J. Mullen, Jr.

*Attorney, Agent, or Firm*—Robin, Blecker, Daley & Driscoll

[57] ABSTRACT

In an electronic article surveillance system, a jamming apparatus is provided for establishing a jamming zone in which tags can be situated and not respond to message signals from a surveillance system transmitter and in which the surveillance system receiver can be situated and still respond to tag signals.

20 Claims, 3 Drawing Sheets

JAMMING APPARATUS FOR ELECTRONIC ARTICLE SURVEILLANCE SYSTEMS

BACKGROUND OF THE INVENTION

This invention relates to an electronic article surveillance system and, in particular, to a system in which a clear line of demarcation is to be maintained between a surveillance zone and adjacent areas.

U.S. Pat. No. 4,686,513, issued Aug. 11, 1987, for "Electronic Surveillance Using Self-Powered Article Attached Tags", and assigned to the same assignee as the present application, describes a surveillance system in which interrogation signals are transmitted by a surveillance transmitter into a surveillance zone. A surveillance receiver is then provided to receive signals transmitted from self powered tags situated in the zone. These tags each comprise a tag receiver for receiving and decoding the interrogation signals transmitted by the surveillance transmitter and a tag transmitter responsive to the receipt of a valid interrogation signal for transmitting an alarm signal to the surveillance receiver.

As described in the '513 patent, it is desirable to have clearly defined lines of demarcation between the surveillance zone and certain adjacent areas (e.g. article display areas), where articles having attached tags may be present prior to checkout and removal from the premises. Failure to have such lines of demarcation can result in tags, located in these adjacent areas, inadvertently responding to interrogation signals and erroneously initiating alarm transmissions.

In the '513 patent, a clear line of demarcation is maintained between the surveillance zone and desired adjacent areas by transmitting, in these areas, a further digital signal which is synchronous with and complementary to the interrogation signal. As a result, the interrogation signal and the further signal combine in these areas to form a composite signal which has no meaningful signal content when decoded by a tag's receiver. Therefore, tags subject to the composite signal do not generate a response, as they would if only an interrogation signal were present.

In the above-described system, the transmitters for the interrogation signal and further signal are synchronized to prevent the further signal from being transmitted during a time period in which an alarm transmission is expected from a tag. Failure to properly synchronize the transmitters could result in the surveillance receiver being interfered with or jammed by the further signal and, therefore, prevented from properly receiving such an alarm transmission. The need to provide for synchronization, however, results in an increased system cost and complexity.

It is, therefore, an object of the present invention to provide an improved electronic article surveillance system.

It is a further object of the present invention to provide an electronic article surveillance system in which a clear line of demarcation is maintained between a surveillance zone and adjacent areas without adversely effecting the surveillance system receiver.

SUMMARY OF THE INVENTION

In accordance with the principles of the present invention, the above and other objectives are realized in an article surveillance system in which a jamming apparatus is provided for establishing a jamming zone which extends into a surveillance zone and in which tags can be situated and not respond to interrogation message signals. More particularly, the jamming apparatus transmits a jamming signal within the jamming zone, which jamming signal is such as to inhibit tags from responding to message signals in the jamming zone, and which is also such as to permit the surveillance receiver, if within the jamming zone, to respond to tag signals.

In the disclosed embodiment, the tag receiver has a first operating frequency band and the surveillance receiver has a second operating frequency band. The jamming apparatus transmits throughout the jamming zone a jamming signal that is within the first frequency band but outside of the second frequency band. This results in a tag, situated in the jamming zone, not responding to interrogation message signals because of the presence of the jamming signal which is within the receiving band of the tag receiver. The surveillance system receiver, on the other hand, if situated in the jamming zone, is not prevented from responding to tag signals, since the jamming signal is outside the receiving band of the surveillance receiver and, hence, does not jam the tag signals.

BRIEF DESCRIPTION OF THE DRAWINGS

The above and other features and aspects of the present invention will become more apparent upon reading the following detailed description in conjunction with the accompanying drawings in which.

DETAILED DESCRIPTION

Figure 1:
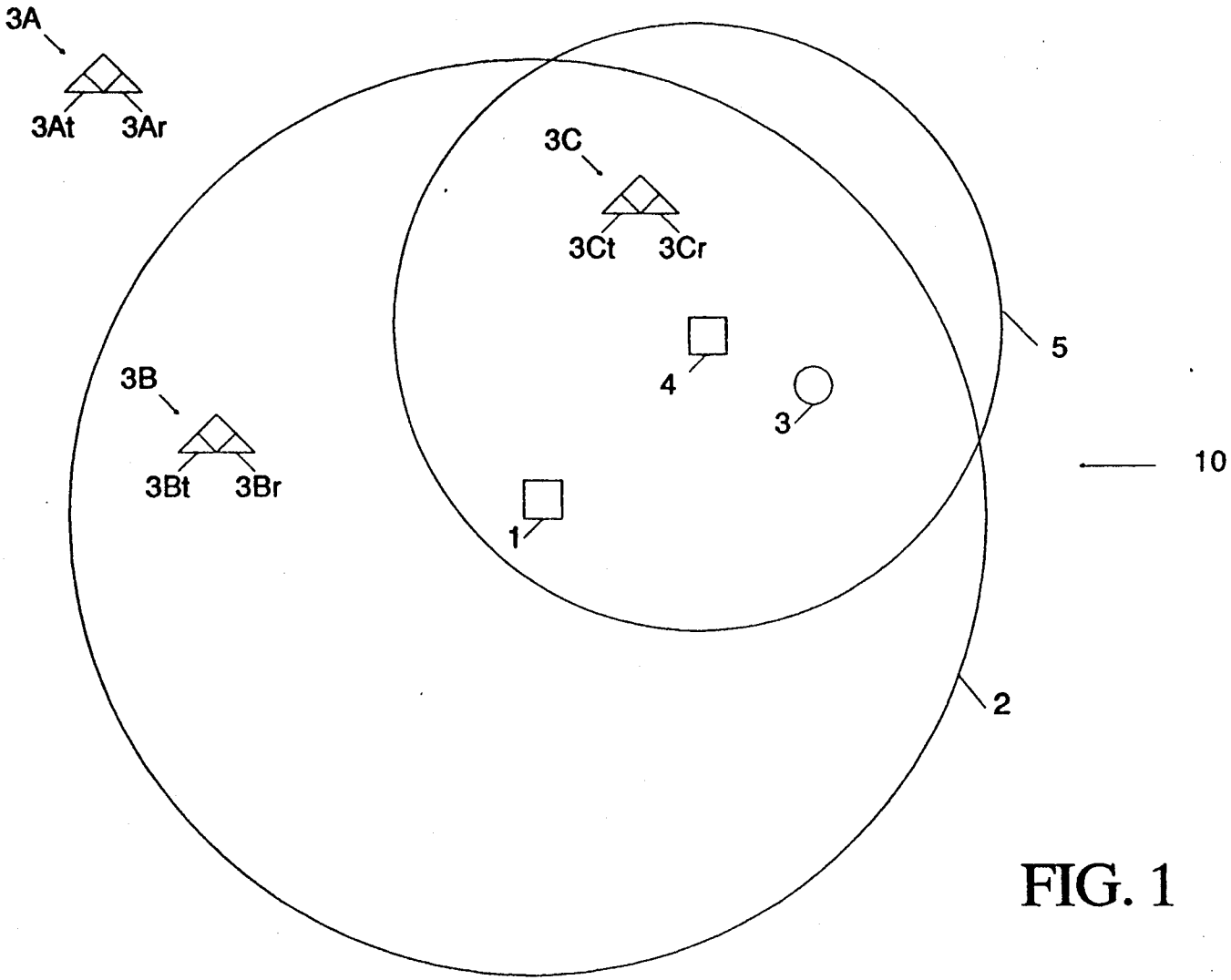
FIG. 1 shows an article surveillance system in accordance with the principles of the present invention.

FIG. 1 shows an electronic article surveillance system 10 in accordance with the principles of the present invention. The surveillance system 10 comprises a surveillance zone 2 into which interrogation message signals are transmitted by a surveillance transmitter 1. A surveillance receiver 3 is provided to receive and respond to information signals transmitted by tags, shown illustratively as tags 3A–C attached to articles to be detected.

The tags 3A–3C contain respective tag receivers 3Ar–3Cr for receiving and decoding the interrogation message signals generated by the surveillance transmitter 1 and available at the respective tag locations. Further, the tags 3A–3C comprise respective tag transmitter 3At–3Ct for transmitting tag information to the surveillance receiver 3 in response to an interrogation message signal.

It is often desired to have article display areas which are at least partially within the boundary of the surveillance zone 2. Such positioning enhances article presentation and increases the total floor space available for situating articles. In such case, however, it is also desired that the tags attached to the articles in the display areas do not respond to the interrogation signals from the surveillance transmitter 1, but that the surveillance receiver 3 still be able to respond to tag signals.

In accordance with the principles of the present invention, this is accomplished in the system 10 by further providing a jamming apparatus 4 which transmits a jamming signal into a jamming zone 5 which at least partially overlaps with the surveillance zone 2. More particularly, the jamming signal is such that it prevents tags in the zone 5 from responding to interrogation message signals from the surveillance transmitter 1. The jamming signal is further such that it does not inhibit or prevent the surveillance receiver 3 from responding to tag signals.

As a result of the jamming signal, the zone 5 thus provides a clear line of demarcation from the surveillance zone 2. Articles can therefore be displayed in the zone 5 without the tags on the articles erroneously alarming themselves or the surveillance system. Furthermore, the zone 5 can encompass the surveillance receiver 3 without affecting its ability to respond to tag signals.

In accordance with the illustrative embodiment of the invention, the jamming signal of the jamming apparatus 4 is selected to be within the frequency band of operation of the receivers of the tags 3A–3C, but outside the frequency band of operation of the surveillance receiver 3. As a result, tags (such as the tag 3C) within the jamming zone 5 will be able to receive the jamming signal and thereby be prevented from responding to interrogation signals also being received. However, the surveillance receiver 3 will not be subject to the jamming signal, since the signal is outside its frequency band of operation. Thus, the receiver will be able to respond to signals from tags (such as tags 3B and 3C) situated within the surveillance zone 2, even if the receiver is subjected to the jamming signal. The above is illustrated in further detail in FIGS. 2A–2C.

Figure 2A:
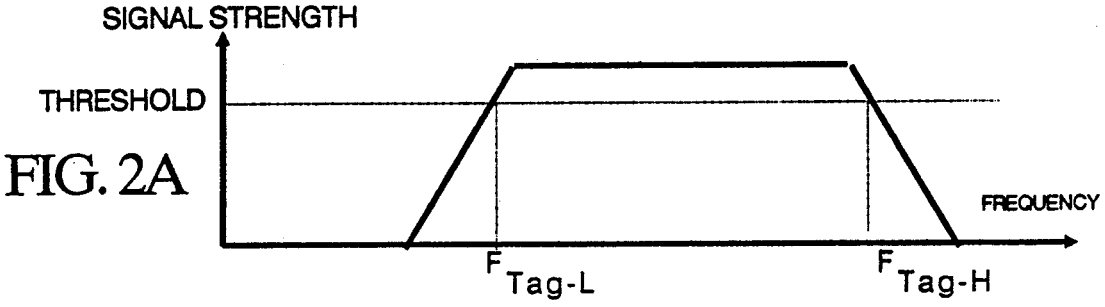
FIGS. 2A–2C illustrate the operating frequency bands of the tag receiver, the surveillance receiver, and the jamming apparatus of the system of FIG. 1.

FIG. 2A shows the operating band or bandwidth of each tag receiver 3Ar–3Cr as a function of frequency versus signal strength. As shown, each receiver has a receive band between $F_{Tag\text{-}L}$ and $F_{Tag\text{-}H}$. Signals within this band, having amplitude greater than a given threshold value, will thus be received and decoded by each tag.

Figure 2B:
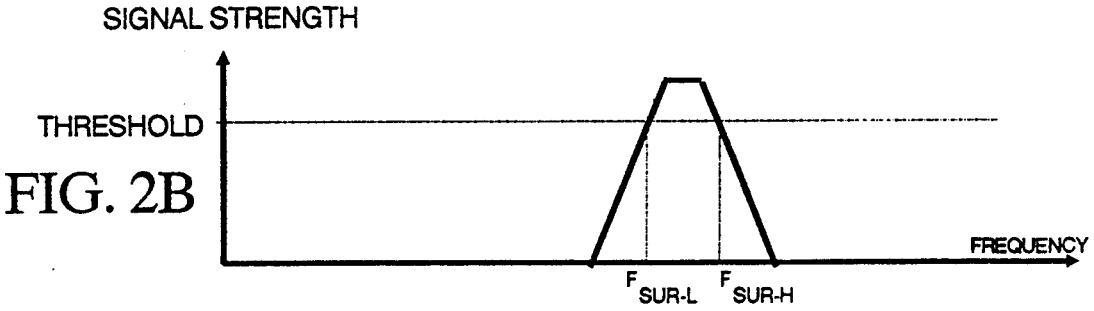

FIG. 2B similarly shows the operating band of the surveillance receiver 3. In this case, the receive bandwidth is between $F_{Sur\text{-}L}$ and $F_{Sur\text{-}H}$ and, hence, signals within this bandwidth, having amplitude greater than a given threshold value, will be received and decoded by the receiver.

Figure 2C:
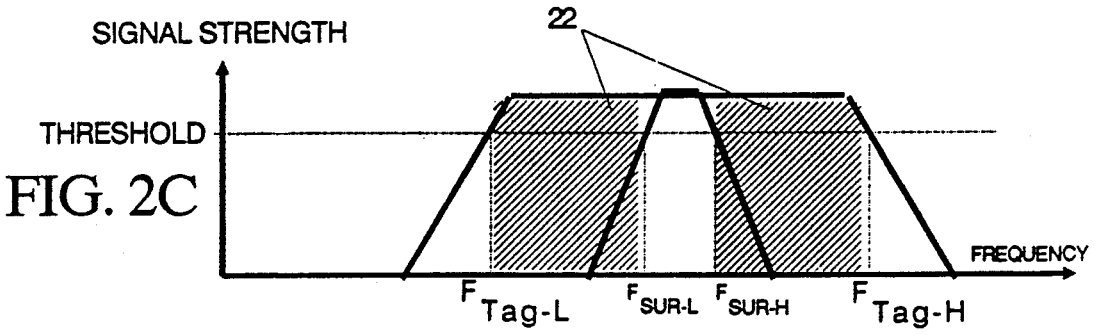

FIG. 2C shows a common plot of the tag receiver bandwidth of FIG. 2A and the surveillance receiver bandwidth of FIG. 2B. FIG. 2C also shows the bandwith 2 of the jamming signal. As can be seen, the bandwidth 22 lies outside the system receiver bandwith and, in particular, lies in the bands $F_{Sur\text{-}L}$ - $F_{Tag\text{-}L}$ and $F_{Tag\text{-}H}$- $F_{Sur\text{-}H}$.

As can be appreciated, therefore, the tag 3C, which is located in the overlapping region of the jamming zone 5 and the surveillance zone 2, will receive a composite signal which comprises the message signal transmitted by the surveillance transmitter 1 and the jamming signal transmitted by the jamming apparatus 4. Since both signals are within the tag receiver bandwidth, the tag will be unable to isolate the message signal content from the composite signal. Therefore, the tag will not respond to the message signal.

As can be further appreciated, if the surveillance receiver 3 is located within the jamming zone 5, it also receives a composite signal comprising the tag information transmitted by a tag (e.g., the tag 3B or 3C) and the jamming signal transmitted by the jamming apparatus 4. However, since the jamming signal is outside the bandwidth of the surveillance receiver 3, the surveillance receiver will ignore the jamming signal and will properly decode the tag information transmission and will respond accordingly.

While FIG. 2C shows the jamming signal as comprising all frequencies in the bandwith 22, the signal need only comprise one or more frequencies. Furthermore, the bandwith can be extended above $F_{Tag\text{-}H}$ and below $F_{Tag\text{-}L}$. Also, the jamming signal can be either a continuous wave or may comprise intermittent bursts.

Figure 3:
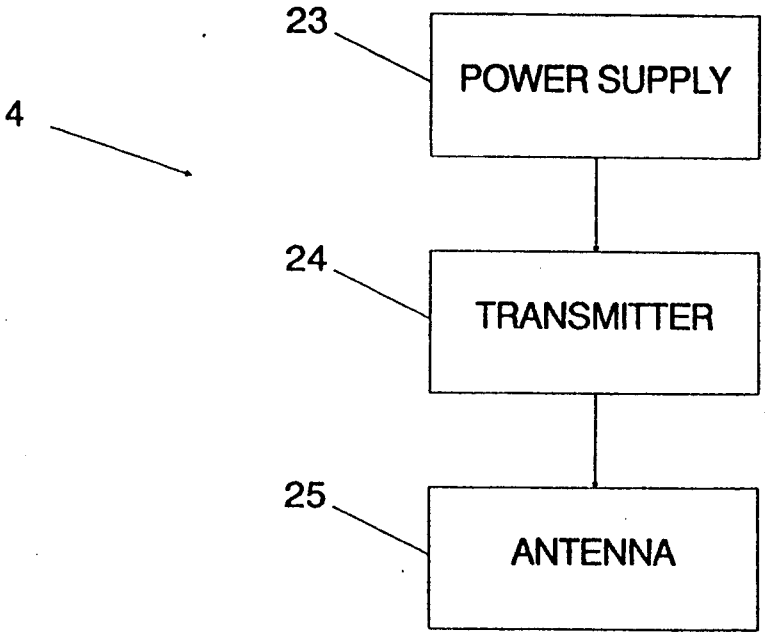
FIG. 3 shows a more detailed block diagram of the jamming apparatus of the system of FIG. 1.

In FIG. 3, the jamming transmitter 4 is shown in greater detail. A power supply 23 supplies power to a transmitter 24, the transmitter generating a signal within the jamming signal bandwidth 22. The transmitter 24 supplies the generated signal to an antenna 25 which, in turn, radiates the jamming signal. Although the jamming zone 5 is shown for illustrative purposes as circular, its actual configuration will depend upon the antenna configuration and the particular application.

It should be noted that the jamming signal may be selected in a variety of other ways so as to prevent the tag receivers from responding to interrogation message signals from the surveillance transmitter 1, while not inhibiting the surveillance receiver 3 from responding to tag signals.

It should be also noted that the system 10 can be a system which detects articles at the exit areas of a store or at any other areas in a store such as, for example, the checkout areas. The particular areas to be placed under surveillance will, in turn, dictate the region covered by the surveillance zone 2, as well as the particular locations for the surveillance receiver and transmitter equipment.

In all cases it is understood that the above-described arrangements are merely illustrative of the many possible specific embodiments which represent applications of the present invention. Numerous and varied other arrangements can be readily devised in accordance with the principles of the present invention without departing from the spirit and scope of the invention.

What Is claimed Is

1. A jamming apparatus for use in an article surveillance system of the type employing tags attached to articles to be placed under surveillance, the article surveillance system having a surveillance zone into which a surveillance transmitter transmits message signals for the tags and a surveillance receiver for receiving information from the tags, each tag having a tag receiver for detecting the message signals, the apparatus comprising:

means for establishing a jamming zone extending into the surveillance zone and in which tags can be situated and not respond to the message signals, said establishing means including: means for transmitting a jamming signal within the jamming zone, said jamming signal being such as to inhibit a tag from responding to message signals in the jamming zone, and such as to permit the surveillance receiver, if within the jamming zone and subject to the jamming signal, to respond to information from the tags.

2. A jamming apparatus in accordance with claim 1, wherein:

said tag receiver has a first operating frequency band; and said jamming signal is a signal within said first frequency band.

3. A jamming apparatus in accordance with claim 2, wherein:

said surveillance receiver has a second operating frequency band; and said jamming signal is a signal outside said second frequency band.

4. A jamming apparatus in accordance with claim 3, wherein:

said means for transmitting a jamming signal comprises:

power supply means;

transmitter means for generating said jamming signal, said transmitter means receiving power from said power supply means; and antenna means for radiating said jamming signal generated by said transmitter means.

5. A jamming apparatus in accordance with claim 3 wherein:

said jamming signal is one of a pulsed signal and a continuous wave.

6. A method for use with an article surveillance system of the type employing tags attached to articles to be placed under surveillance, the article surveillance system having a surveillance zone into which a surveillance transmitter transmits message signals for the tags and a surveillance receiver for receiving information from the tags, each tag having a tag receiver for detecting the message signals, the method comprising:

establishing a jamming zone extending into the surveillance zone and in which tags can be situated and not respond to the message signals, the step of establishing comprising: transmitting a jamming signal within the jamming zone, said jamming signal being such as to inhibit a tag from responding to message signals in the jamming zone, and such as to permit the surveillance receiver, if within the jamming zone and subject to the jamming signal, to respond to information from the tags.

7. A method in accordance with claim 6, wherein:

said tag receiver has a first operating frequency band; and said jamming signal is a signal within said first frequency band.

8. A method in accordance with claim 7, wherein:

said surveillance receiver has a second operating frequency band; and said jamming signal is a signal outside said second frequency band.

9. A method in accordance with claim 8, wherein:

said transmitting step comprises:

providing a power supply means;

providing a transmitter means for generating said jamming signal, said transmitter means receiving power from said power supply means; and providing an antenna means for radiating said jamming signal generated by said transmitter means.

10. A method in accordance with claim 8 wherein:

said jamming signal is one of a pulsed signal and a continuous wave.

11. An article surveillance system of the type employing tags attached to articles to be placed under surveillance in a surveillance zone, each tag having a tag receiver for detecting message signals, the surveillance system comprising:

a surveillance transmitter for transmitting message signals into the surveillance zone for the tags;

a surveillance receiver for receiving information from the tags;

a jamming apparatus comprising means for establishing a jamming zone extending into the surveillance zone and in which tags can be situated and not respond to the message signals, said establishing means including: means for transmitting a jamming signal within the jamming zone, said jamming signal being such as to inhibit a tag from responding to message signals in the jamming zone, and such as to permit the surveillance receiver, if within the jamming zone and subject to the jamming signal, to respond to information from the tags.

12. A system in accordance with claim 11, wherein:

each said tag receiver has a first operating frequency band; and said jamming signal is a signal within said first frequency band.

13. A system in accordance with claim 12, wherein:

said surveillance receiver has a second operating frequency band; and said jamming signal is a signal outside said second frequency band.

14. A system in accordance with claim 13, wherein:

said means for transmitting a jamming signal comprises:

power supply means;

transmitter means for generating said jamming signal, said transmitter means receiving power from said power supply means; and antenna means for radiating said jamming signal generated by said transmitter means.

15. A jamming apparatus in accordance with claim 13 wherein:

said jamming signal is one of pulsed signal and a continuous wave.

16. An article surveillance method in which articles are placed under surveillance in passing through a surveillance zone by detecting tags attached to the articles, each tag having a tag receiver for detecting message signals, the surveillance method comprising:

transmitting message signals into the surveillance zone for the tags;

receiving information from the tags; and establishing a jamming zone extending into the surveillance zone and in which tags can be situated and not respond to the message signals, said establishing including: transmitting a jamming signal within the jamming zone, said jamming signal being such as to inhibit a tag from responding to message signals in the jamming zone, and such as to permit the surveillance receiver, if within the jamming zone and subject to the jamming signal, to respond to information from the tags.

17. A method in accordance with claim 16, wherein:

each said tag receiver has a first operating frequency band; and said jamming signal is a signal within said first frequency band.

18. A method in accordance with claim 17, wherein:

said surveillance receiver has a second operating frequency band; and said jamming signal is a signal outside said second frequency band.

19. A method in accordance with claim 18, wherein:

said step of transmitting a jamming signal comprises:

providing power supply means;

providing a transmitter means for generating said jamming signal, said transmitter means receiving power from said power supply means; and providing an antenna means for radiating said jamming signal generated by said transmitter means.

20. A method in accordance with claim 18 wherein:

said jamming signal is one of pulsed signal and a continuous wave.

* * * * *